United States Patent [19]

Windley

[11] 3,971,202

[45] July 27, 1976

[54] COBULKED CONTINUOUS FILAMENT YARNS

[75] Inventor: William Thomas Windley, Seaford, Del.

[73] Assignee: E. I. Du Pont de Nemours and Company, Wilmington, Del.

[22] Filed: July 22, 1975

[21] Appl. No.: 597,980

Related U.S. Application Data

[63] Continuation-in-part of Ser. No. 495,831, Aug. 8, 1974, abandoned.

[52] U.S. Cl. ..... 57/140 BY; 57/157 F; 57/157 AS

[51] Int. Cl.[2] ..... D02G 3/12

[58] Field of Search ..... 57/34 B, 140 R, 140 BY, 57/144, 157 R, 157 F, 157 AS, 160, 157 TS

[56] References Cited

UNITED STATES PATENTS

| | | | |
|---|---|---|---|
| 3,186,155 | 6/1965 | Breen et al. | 57/140 BY X |
| 3,199,281 | 8/1965 | Maerov et al. | 57/157 F X |
| 3,410,076 | 11/1968 | Dyer | 57/140 BY |
| 3,410,077 | 11/1968 | Marzocchi et al. | 57/157 F X |
| 3,447,302 | 6/1969 | Field | 57/157 F |
| 3,568,424 | 3/1971 | Marshall | 57/157 F |
| 3,582,445 | 6/1971 | Okuhashi | 57/157 AS |
| 3,586,597 | 6/1971 | Okuhashi | 57/157 AS X |
| 3,691,750 | 9/1972 | Waters | 57/140 BY |
| 3,911,655 | 10/1975 | London et al. | 57/34 B X |

FOREIGN PATENTS OR APPLICATIONS

| | | | |
|---|---|---|---|
| 1,216,515 | 12/1970 | United Kingdom | 57/157 AS |

*Primary Examiner*—Donald E. Watkins

[57] ABSTRACT

Described is cobulked continuous filament yarn containing a first yarn and a second yarn having some special quality such as an electrically conductive yarn, a flame-retardant yarn, a yarn having soil release properties or a yarn having some aesthetic quality such as an unusual dye characteristic or unusual luster characteristic, in which the filaments of the second yarn are about 4 to about 20 percent longer than the filaments of the first yarn, whereby the effect of the second yarn is increased by an increase in the appearance of its filaments at the surface of the cobulked yarn. These cobulked continuous filament yarns are produced by drawing the first yarn by wrapping it at least four times around a pair of rolls driven at a rate at least twice the feed rate, wrapping a second continuous filament yarn having a lower shrinkage potential than the drawn, first yarn at least four times around the pair of rolls without drawing, combining the two yarns together on the rolls, and cobulking the combined yarn using a hot fluid bulking jet.

19 Claims, 2 Drawing Figures

COBULKED CONTINUOUS FILAMENT YARNS

CROSS-REFERENCE TO RELATED APPLICATION

This is a continuation-in-part of copending application Ser. No. 495,831, filed Aug. 8, 1974, now abandoned.

BACKGROUND OF THE INVENTION

1. Field of the Invention

This invention relates to the production of improved cobulked continuous filament yarn by cobulking a first and second yarn whereby filaments of the second yarn are frequently located near the surface of the cobulked yarn. More particularly, this invention relates to antistatic, continuous filament yarn obtained by cobulking non-conductive and conductive yarns.

2. Description of the Prior Art

It is known to use conductive filaments in carpets and other fabrics to prevent the accumulation of static electricity. The current standard for static electricity in the carpet industry is carpets having a shuffle voltage of less than 3.0 kilovolts (KV). No completely satisfactory system has been provided for meeting this standard. Prior art systems either impart undesirable aesthetic qualities to the carpet, are uneconomical, or lack durability.

Methods for combining two or more yarns and feeding them at the same or different rates to a fluid jet texturing or crimping operation are known from such patents as Breen U.S. Pat. No. 2,852,906, Field U.S. Pat. No. 3,447,392, and Breen and Lauterbach U.S. Pat. No. 3,186,155. The Breen and Field patents teach that two different yarns can be fed into a cold air bulking jet at different feed rates. The Breen and Lauterbach patent teaches that tension stable bulky yarns can be produced by hot fluid jet bulking two or more yarns using different tensions or different feed rates.

SUMMARY OF THE INVENTION

This invention provides cobulked continuous filament yarn which comprises a first continuous filament yarn cobulked with a second continuous filament yarn in which the filaments of said cobulked yarn have random, three-dimensional curvilinear crimp with alternating regions of S and Z filament twist, the filaments of said second yarn are about 4 to about 20 percent longer than the filaments of said first yarn, and the filaments of said second yarn are frequently located near the surface of cobulked yarn.

This invention also provides a method of producing a cobulked continuous filament yarn containing filaments of a first continuous filament yarn and filaments of a second continuous filament yarn in which the filaments of said second yarn are frequently located near the surface of said cobulked yarn which comprises 1. feeding said first yarn at a controlled rate of speed,
2. wrapping said first yarn at least four times around a pair of rolls driven at a rate at least twice the feed rate, thereby drawing said first yarn,
3. feeding to the pair of rolls, at a tension of less than about 0.6 gram per denier, said second yarn having a lower shrinkage potential in a hot gas bulking jet than the drawn, first yarn,
4. wrapping said second yarn at least four times around the pair of rolls, 5. bringing said first and second yarns together on the rolls thereby forming a combined yarn,
6. forwarding the combined yarn in a high velocity stream of hot turbulent fluid in a confined space to randomly crimp and entangle the filaments thereby forming a cobulked yarn in which the filaments of said second yarn are about 4 to about 20 percent longer than the filaments of said first yarn.
7. removing the cobulked yarn from the stream of hot fluid, and
8. allowing the cobulked yarn to cool at low tension while the filaments are in a crimped condition.

DETAILED DESCRIPTION OF THE DRAWINGS

Figure 1:
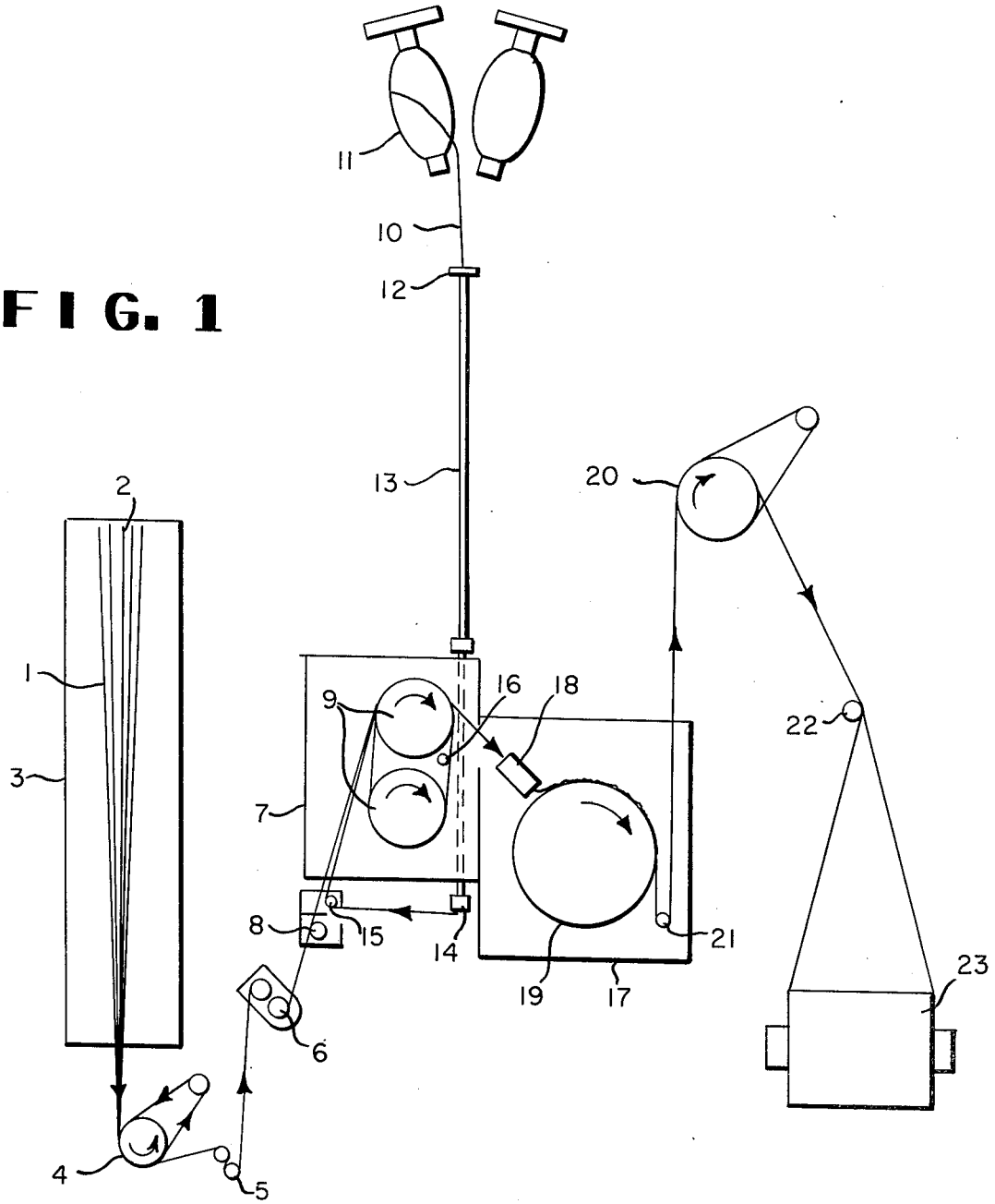
FIG. 1 is a schematic representation of a preferred embodiment of the process of the invention.

FIG. 1 shows a first yarn 1 being extruded at spinneret 2 with subsequent quench by cross flow air at chimney 3. Feed roll 4 at the base of the chimney controls yarn speed and spun yarn denier. The yarn is then drawn across two sets of draw pins 5 and 6 and guided into an enclosure or chest 7 by entrance guide 8. A pair of rolls 9 in the enclosure are internally heated and have a surface speed at least twice that of feed rolls 4 adjusted to impose the desired draw ratio on the yarn.

A second yarn 10 having a lower shrinkage potential in a hot gas bulking jet than the drawn first yarn is delivered from supply package 11 and passes through guide 12 and transport tube 13. A ceramic guide 14 is provided on the lower end of the tube to reduce wear and tension build up. Guide pin 15 is situated to keep the first and second yarns separated in planes both parallel and perpendicular to the drawing. The two yarns are combined after the first ½ wrap on the top chest roll by passing through guide 16. From this point on, the two yarns are processed as a single combined yarn bundle. Both yarns are wrapped 9 ½ times on pair of rolls 9. The combined yarn passes from enclosure 7 into chamber 17.

Figure 2:
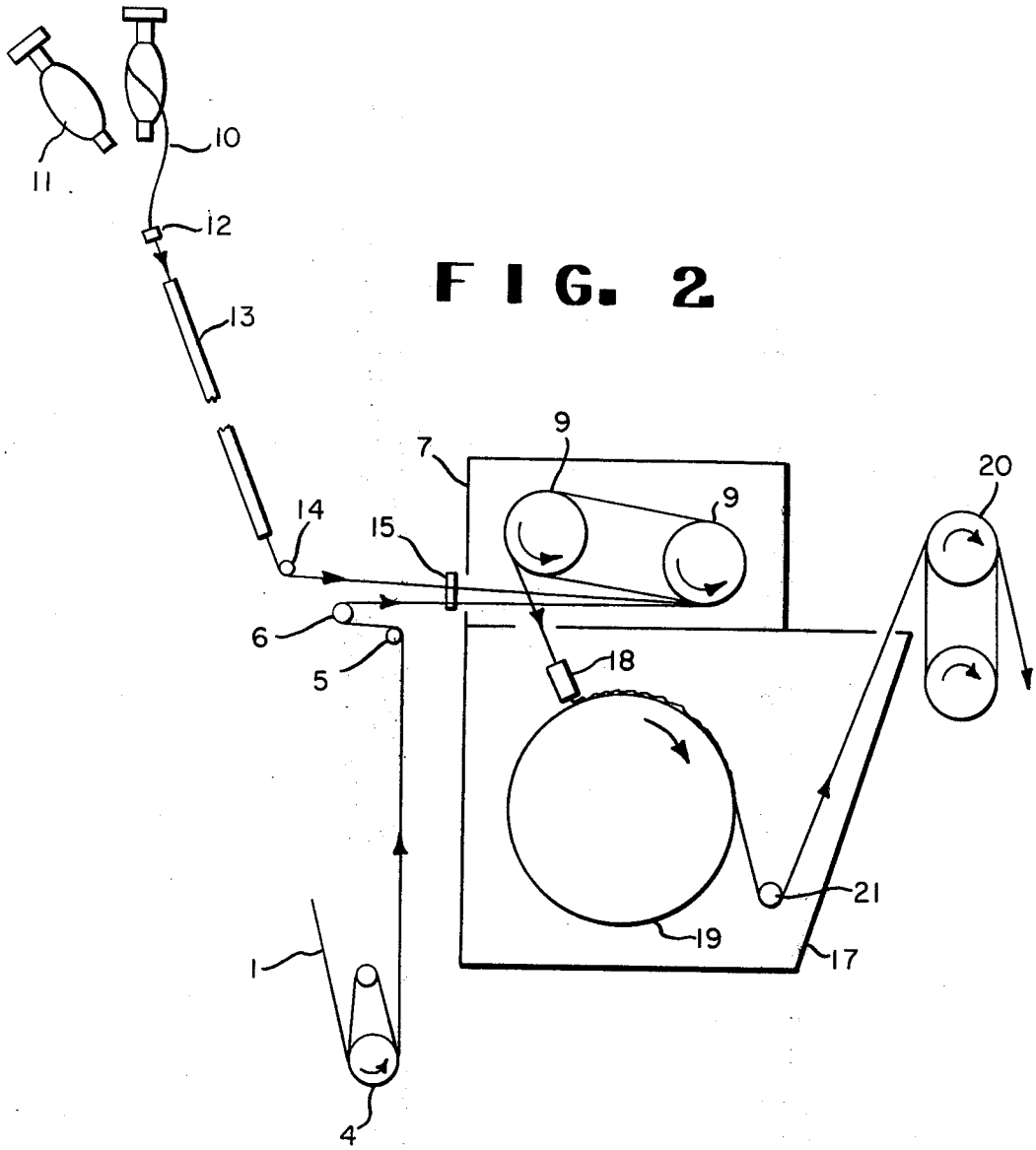
FIG. 2 shows a process similar to that of FIG. 1 except for a slightly different arrangement of machine elements.

Bulking jet 18 forwards the yarn in a high velocity stream of hot turbulent fluid such as air or steam in a confined space to randomly crimp and entangle the filaments and deposit them in a crimped condition on the screen surface of drum 19 moving at a much slower speed than the yarns. Here they are cooled, then takeup roll 20 pulls the combined yarn off drum 19 around guide 21. The yarn then passes guide 22 to windup 23 which applies sufficient tension to wind a firm package. In FIG. 2 freshly spun first yarn 1 passes around feed rolls 4 and then over draw pins 5 and 6 into chamber 7 to heated draw rolls 9 rotating at a surface speed at least twice that of feed rolls 4. Second yarn 10 is delivered from supply package 11 and travels through guide 12 and tube 13 and around guide 14 to heated draw rolls 9 within enclosure 7. At the entrance to the enclosure, guide 15 fixes the positions of the two yarns so that they are separated by approximately 1/16 inch as they wrap on the first draw roll. Both yarns are wrapped 7 ½ times on rolls 9. The combined yarn leaves enclosure 7 through suitable guides, enters chamber 17 and passes to bulking jet 18 which forwards it in a stream of high velocity hot turbulent fluid in a confined space. The yarn is crimped and entangled and deposited on the screen surface of drum 19 revolving at a much slower speed than draw rolls 9. The crimped filaments are cooled on the screen surface by air which is drawn inwardly through the screen by a vacuum at the drum interior and also by a spray of cooling liquid or finish. The cooled yarn is then drawn from drum 19 past guide 21 by rolls 20 and is tensioned and wound on a package.

DETAILED DESCRIPTION OF THE INVENTION

This invention relates to cobulked continuous filament yarns having some special quality, for example, an antistatic, flame retardant or soil release character, or an unusual aesthetic quality such as color or luster. In one preferred embodiment it has been found that, in the cobulked yarns of this invention, the presence of as little as about 5 percent or less of the yarn having special quality imparts a surprisingly large effect upon the resulting cobulked yarn.

In another preferred embodiment of this invention antistatic yarns are prepared by cobulking electrically non-conductive and electrically conductive yarns. The resulting cobulked yarns are useful in the production of carpets. The invention will be described primarily in terms of such yarns.

It has been discovered in accordance with this invention that in order to provide antistatic cobulked continuous filament yarns which meet the current standard for the carpet industry it is necessary that there be a high degree of entanglement and that the conductive filaments be frequently located near the surface of the cobulked yarn. This result is accomplished by the process of this invention in which non-conductive and conductive yarns are cobulked in a hot fluid bulking jet under conditions such that the conductive filaments in the cobulked yarn are about 4 to about 20 percent longer than the non-conductive filaments.

The non-conductive yarn used in the process of this invention may be any drawable, continuous filament, synthetic thermoplastic, polymeric fiber material such as polyamide, polyester, or polyolefin. The conductive yarn may be selected from the same group of materials as the non-conductive yarn, but in addition may also include non-thermoplastic and non-drawable materials. The conductivity of the conductive yarn may be provided in a number of ways such as using a crimpable metallic wire or foil, depositing a conductive layer on or laminating a conductive layer with a non-conductive material, a conductive homofiber, or a sheath-core fiber in which the core is a conductive material. The preferred conductive yarn is a sheath-core fiber in which the sheath is nylon and the core is a conductive carbon/polyethylene blend as described by Hull in U.S. Pat. No. 3,803,453.

The two yarns can be cobulked in any proportions. The proportions may vary from a single filament of nonconductive yarn which will act as the load bearing filament in the cobulked yarn to a single filament of conductive yarn which will impart conductivity to the cobulked yarn. Preferably the non-conductive yarn is at least about 50 percent by weight of the cobulked yarn and most preferably is at least about 95 percent.

The cobulking process is carried out by hot fluid jet bulking as described by Breen and Lauterbach in U.S. Pat. No. 3,186,155, and Canadian Pat. No. 651,831. Because of the turbulent and random fluid currents in this type of bulking chamber, the resulting crimp in the filament is three-dimensional and random in amplitude and period. The high degree of turbulence in a confined space results in a very high crimp level, and a curvilinear rather than a rectangular, saw-tooth, helical or crunodal loop type of filamentary configuration. The individual filaments produced by this bulking technique possess alternating regions of S and Z filament twist throughout their length, with at least one S turn and at least one Z turn per inch of filament.

The process of the invention permits both yarns to be fed to the crimping jet at the same speed without need for the additional cost of rolls driven at separate speeds, but results in the filaments of the conductive yarn being substantially longer than the filaments of the nonconductive yarn after crimping. This difference in length will be called "Differential Filament Length" (DFL). The method for measuring DFL is described in more detail below.

Since the non-conductive yarn is being drawn and is thereby at higher tension than the conductive yarn as they are wrapped on the pair of rolls 9, the non-conductive yarn retracts elastically to a greater degree than the conductive yarn as they leave the pair of rolls to enter the crimping operation. This difference in retraction resulting from the difference in tension contributes to some extent to the difference in filament length.

The difference in tension may be accentuated by providing unusually low uniform tension on the conductive yarn by such means as delivering the conductive yarn downward from inverted packages, minimizing contacts with guides or other surfaces, and providing such contact surfaces with low friction materials. For continuous filament nylon yarn a tension of less than about 0.6 gram per denier should be used. Preferably the tension on the conductive yarn is such that it causes less than about 5 percent elongation of the conductive yarn.

Another important factor which contributes to the difference in filament length is shrinkage. The conductive yarn should have a lower shrinkage potential in a hot gas bulking jet than the drawn, non-conductive yarn. By "lower shrinkage potential" it is meant that the non-conductive yarn undergoes a greater degree of shrinkage than the conductive yarn when they are subjected to the same hot jet bulking operation. A number of factors affect the relative degree of shrinkage which the two types of filaments undergo during hot jet bulking. For example, a higher draw ratio and higher degree of orientation gives greater shrinkage. Also a higher temperature of the heating rolls usually gives greater total reduction in length due to a combination of shrinkage and crimp formation in the jet crimping step. Higher temperature in the jet, also, usually produces greater shrinkage.

When the conductive and non-coductive yarns are of the same polymer, relative shrinkage between the two depends on the degree of molecular orientation, the more highly oriented filaments shrinking more. The conductive filaments should have a lower degree of orientation than the non-conductive filaments at the time that they undergo hot fluid jet bulking, so that the non-conductive filaments will undergo a greater degree of shrinkage. This factor is a major contribution to differential filament length. When the two yarns are of different polymers, DFL adjustments can be made by changing the orientation of either or both of the yarns.

Heat may be applied to the yarns while they are wrapped on the pair of rolls 9 either by heating one or more of the rolls themselves or by enclosing the rolls in a chest through which hot air or other hot fluid is circulated. An enclosure is desirable in any case to conserve heat. Hot fluid jet crimping requires careful control of feed yarn properties and yarn tensions and speeds because the high heat, turbulent flexing, and sudden relaxation usually greater shrinkages than are observed when yarns are subjected to heating in an oven or boiling water.

The conductive filaments in the cobulked yarn must be about 4 to about 20 percent longer than the non-conductive filaments. Although a DFL of at least about 4 percent is required for the conductive filaments to be frequently located near the surface of the combined yarn, they should not be excessively long. It has been found that, if the DFL exceeds about 13 percent, the conductive filaments tend to separate from the combined yarn and form undesirable surface loops which may catch and snag in processing machinery such as carpet tufting machines, knitting needles, etc. Excessively long loops in yarns with DFL's between about 6 and about 20 percent can be controlled, however, by twisting or plying the yarn before tufting or knitting. Preferably, the DFL should be about 6 to about 13 percent for optimum carpet yarn.

Although this invention has been described in terms of antistatic yarns obtained by cobulking non-conductive and conductive yarns, the invention should not be limited thereto. There are other applications where a more expensive yarn is cobulked with a less expensive yarn and it would be desirable to maximize the effect of the more expensive yarn by increasing its appearance at the surface of the cobulked bundle. For example, this invention would be suitable for preparing flame-retardant yarns in which a non-flame-retardant yarn is cobulked with a more expensive flame-retardant yarn such as an aramid yarn or a yarn having a flame-retardant coating. Similarly, a yarn having soil release properties could be cobulked with a conventional yarn. In other applications, the more expensive yarn may impart some aesthetic quality such as an unusual dye characteristic or an unusual luster characteristic to the cobulked yarn.

TEST PROCEDURE — DIFFERENTIAL FILAMENT LENGTH (DFL)

A sample of cobulked yarn which has been stored on a windup package at least 24 hours after cobulking is tied in a knot about one meter from the end, and a first weight of 0.05 grams per denier is attached to the end. The knotted end of the sample is attached to a clamp more than 2 cm. above the knot and the weighted sample is allowed to hang vertically. It is cut 88 cm. below the knot and 2 cm. above the knot, both positions being determined while the sample is hanging with the weight attached. A dissecting needle is then used to separate the filaments of the conductive yarn from the combined yarn near the end remote from the knot. The ends of these filaments are aligned and the terminal 1 cm. of these filaments is trapped between the adhesive sides of a folded piece of tape. The knot is then clamped to the top end of a vertical measuring device calibrated in centimeters, the zero point being 87 cm. below the knot. A second weight of 0.2 grams per denier is attached to the folded tape. The operator then supports the second weight in one hand and uses the other hand to slide the majority of the combined yarn upward along the conductive filaments in successive steps to within 15 cm. of the knot. The majority of the combined yarn is then slid downward to 40 cm. from the knot, being careful not to stretch the conductive filaments. The second weight is then allowed to hang freely, and the position of the top of the folded tape is measured within 5 seconds. The amount by which the length of the conductive filaments exceeds the non-conductive filaments is recorded as "measured DFL." Percent DFL is then calculated from the equation:

$$\text{DFL (in percent)} = \frac{\text{Measured DFL (cm.)} \times 100}{88}$$

EXAMPLES OF THE INVENTION

The following examples illustrate the novel cobulked yarns of this invention, and their preparation and use. All parts and percentages are by weight unless otherwise specified.

EXAMPLE 1

In this example a conductive yarn is combined with a non-conductive yarn in a process where the non-conductive yarn is spun, drawn and bulked in a coupled operation as shown generally in FIG. 1 except that guide 16 is not used and the source of conductive yarn 10 is in a different position. The non-conductive yarn is nylon 66 containing 68 filaments per threadline, the filaments having a trilobal cross-section. They are quenched with 45°C. air at 150 ft./min. cross flow velocity. Feed roll 4 controls the spun yarn speed at 720 yds. per minute. The yarn is drawn 3.18×. The skewed pair of rolls 9 are internally heated and are enclosed in a chest. They have a surface temperature of 215°C. and a surface speed of 2300 yds./min. With 9½ wraps on the pair of draw rolls, the yarn is preheated and advanced to jet 18 where air at 230°C. and 105 lb/in.$^2$ gauge manifold conditions impinge on it. The yarn is removed from the jet by a moving screen on drum 19 with a surface speed of 178 yds./min. and is held onto the screen by a vacuum inside the drum. The crimped configuration is quenched into the yarn with water mist jets before the yarn is removed from the drum. A takeup roll with a surface speed of 1990 yds./min. removes the yarn from the screen drum and advances it to a windup where the yarn is wound onto tubes at 2000 yds./min.

A conductive yarn described by Hull in U.S. Pat. No. 3,803,453, Example II, is introduced into the described spin-draw-bulk process from yarn supply package 11 below chest roll 9. Its properties are shown in Table I.

The two yarns are kept separate from each other until after the first wrap on the upper roll 9 by adjusting the position of guide 15. Tension on the conductive yarn between the supply package and the chest entrance guide is 8 to 12 gms. (0.35 to 0.52 gms./denier). The variation is due to more or less drag of yarn across the delivery pirn. When yarn is being unwound from the lower end of the pirn (closer to the bullseye guide) less drag is experienced than when yarn is being unwound from the upper end of the pirn. An additional 1 to 2 gms. tension increase is gained when the conductive yarn passes around the guide pin on the chest entrance guide. The filaments of the resulting cobulked yarn have random, three-dimensional curvilinear crimp with alternating regions of S and Z filament twist. The conductive filaments are frequently located near the surface of the cobulked yarn.

TABLE I

| Conductive Yarn Denier | Denier Sheath | Denier Core | Draw Ratio |
|---|---|---|---|
| 15.0 | 9.0 | 6.0 | 3.0X |

| Combined Yarn Denier | Tenacity (grams per denier) | After Boil-Off BCE* | After Boil-Off CPI* | Measured DFL | DFL (%) |
|---|---|---|---|---|---|
| 1335 | 2.75 | 77% | 12 | 10.7 cm. | 12.47 |

*BCE = bulk crimp elongation, see U.S. Pat. No. 3,186,155
*CPI = crimp per inch, see U.S. Pat. No. 3,186,155

Carpet construction and shuffle voltage data for a level loop tufted carpet made with yarn from the process described above are shown in Table II. Shuffle voltage is measured by AATCC Test Method 134-1969 with change adopted by the Carpet and Rug Institute, Sept. 1971.

TABLE II

| Carpet Construction Pile Height | Weight, Oz./Yd.$^2$ | Tuft Gage | No. of Plies | Shuffle Voltage Rating, KV |
|---|---|---|---|---|
| ¼" | 20 | 1/10 | 1 | 1.6 |

EXAMPLE II

In this example a conductive yarn is combined with a non-conductive yarn in a process where the non-conductive yarn is spun, drawn and bulked in a coupled operation as shown in FIG. 1. The non-conductive yarn is nylon 66 having 80 filaments per threadline and a four hold square cross-section as described in U.S. Pat. No. 3,745,961. The filaments are quenched with 45°C. air at 150 ft./min. cross flow velocity. Feed roll 4 controls spun yarn speed at 785 yds. per minute. The yarn is drawn 3.0×. The skewed pair of rolls 9 are internally heated and are enclosed in a chest. They have a surface temperature of 215°C. and a surface speed of about 2355 yds./min. With 9½ wraps on the pair of draw rolls, the yarn is preheated and advanced to jet 18 where air at 245°C. and 120 lb/in.$^2$ gauge manifold conditions impinge on it. The yarn is removed from the jet by a moving screen on a drum with a surface speed of 170 yds./min. and is held onto the screen by a vacuum inside the drum. The crimped configuration is quenched into the yarn with water mist jets before the yarn is removed from drum 19. Takeup roll 20 with a surface speed of 1940 yds./min. removes the yarn from the screen drum and advances it to windup 23 where the yarn is wound onto tubes at 2003 yds./min.

A conductive yarn described by Hull in U.S. Pat. No. 3,803,453, Example II, is introduced into the described spin-draw-bulk process from a vertical supply package. Its properties are shown in Table III.

The two yarns are kept separate from each other until after the first wrap on the upper roll 9. The two yarns are combined at guide 16 which contacts the yarns only after the first of the 9½wraps. Tension on the conductive yarn between the lower end of the transport tube and the chest entrance guide is 8 to 12 gms. (0.35 to 0.52 gms./denier). The variation is due to more or less drag of yarn across the delivery pirn. When yarn is being unwound from the lower end of the pirn (closer to the bullseye guide) less drag is experienced than when yarn is being unwound from the upper end of the pirn. An additional 1 to 2 gms. tension increase is gained when the conductive yarn passes around the guide pin on the chest entrance guide. The filaments of the resulting cobulked yarn have random, three-dimensional curvilinear crimp with alternating regions of S and Z filament twist. The conductive filaments are frequently located near the surface of the cobulked yarn.

TABLE III

| Conductive Yarn Denier | Tenacity, gms./den. | Modulus, gms./den. | Elongation | Boil-Off Shrinkage |
|---|---|---|---|---|
| 22.5 | 3.7 | 14.0 | 90% | 10.5% |

| Combined Yarn Denier | Tenacity, gms./den. | After Boil-Off BCE | After Boil-Off CPI | Measured DFL | DFL, % |
|---|---|---|---|---|---|
| 1245 | 2.8 | 75% | 13 | 7.0 cm. | 8.0 |

Carpet construction and shuffle voltage data for level loop tufted carpets made with yarn from the process described above are shown in Table IV.

TABLE IV

| Carpet Construction Item | Pile Height | Weight, oz./yd.$^2$ | Tuft Gage | No. of Plies | No. of Plies with Conductive Yarn | Shuffle Voltage Rating, KV |
|---|---|---|---|---|---|---|
| A | ¼" | 16 | 1/10 | 1 | 1 | 2.1 |
| B | ¼" | 20 | 1/10 | 3 | 1 | 2.6 |

It should be noted that the conductivity of the cobulked yarn of this invention is sufficient to produce satisfactory carpets when only one yarn ply out of three has conductive filaments, thus reducing the cost of carpeting. Cobulked yarn with a DFL below 4 percent is unsatisfactory when used in one ply out of three.

EXAMPLE III

Process conditions are the same as for Example II. The physical properties of the conductive yarn are somewhat different as shown in Table V due to a reduction in draw ratio from 2.7× to 2.4×.

TABLE V

| Conductive Yarn Denier | Tenacity, gms./den. | Modulus, gms./den. | Elongation | Boil-Off Shrinkage |
|---|---|---|---|---|
| 25.0 | 3.2 | 12 | 110% | 12% |

| Combined Yarn Denier | Tenacity, gms./den. | After Boil-Off BCE | After Boil-Off CPI | Measured DFL | DFL, % |
|---|---|---|---|---|---|
| 1245 | 2.8 | 75% | 13 | 8.5 cm. | 9.7 |

Carpet construction and shuffle voltage data for level loop tufted carpets made from the above cobulked yarns are shown in Table VI.

TABLE VI

| Carpet Construction Item | Pile Height | Weight, oz./yd$^2$ | Tuft Gage | No. of Plies | No. of Plies with Conductive Yarn | Shuffle Voltage Rating, KV |
|---|---|---|---|---|---|---|
| C | ¼" | 16 | 1/10 | 1 | 1 | 1.7 |
| D | ¼" | 20 | 1/10 | 3 | 1 | 2.3 |

EXAMPLES IV, V, VI AND VII

Cobulked yarns are made by the process of FIG. 2. The two yarns are substantially the same as those in Examples II and III, any differences being noted in Table VII.

TABLE VII

| | | Example | | | |
|---|---|---|---|---|---|
| | | IV | V | VI | VII |
| Speed of feed roll 4, ypm | | 934 | 934 | 624 | 624 |
| Speed of draw rolls 9, ypm | | 2795 | 2795 | 1873 | 1873 |
| Non-Conductive Yarn | — Approx. denier at draw rolls 9 | 1093 | 1093 | 1642 | 1642 |
| | — Number of filaments | 80 | 80 | 80 | 80 |
| | — Tension approaching draw rolls 9, grams per denier | 1.1 | 1.1 | .85 | .85 |
| | — Twist | 0 | 0 | 0 | 0 |
| Conductive Yarn | — Denier | 23 | 26 | 23 | 26 |
| | — Number of filaments | 3 | 3 | 3 | 3 |
| | — Twist — turns per inch | 0.26 | 0.26 | 0.26 | 0.26 |
| | — Draw Ratio | 2.7 | 2.4 | 2.7 | 2.4 |
| | — Tension approaching draw rolls 9, grams per denier | .24–.52 | .21–.46 | .17–.26 | .15–.23 |
| Number wraps on draw rolls 9 | | 7½ | 7½ | 7½ | 7½ |
| Temperature (°C.) — Draw rolls 9 | | 213 | 213 | 213 | 213 |
| Bulking Jet 18 | — Air pressure — pounds per square inch gauge | 110 | 110 | 110 | 110 |
| | — Air temperature — °C. | 235 | 235 | 235 | 235 |
| Combined Yarn | — Denier | 1245 | 1245 | 1820 | 1820 |
| | — Number of filaments | 83 | 83 | 83 | 83 |
| | — Average measured DFL, cm. | 6.2 | 8.8 | 5.6 | 7.5 |
| | — DFL, % | 7.0 | 1.0 | 6.4 | 8.5 |

I claim:

1. A cobulked continuous filament yarn which comprises a first continuous filament yarn cobulked with a second continuous filament yarn in which the filaments of said cobulked yarn have random, three-dimensional curvilinear crimp with alternating regions of S and Z filament twist, the filaments of said second yarn are 4 to 20 percent longer than the filaments of said first yarn, and the filaments of said second yarn are frequently located near the surface of the cobulked yarn.

2. The cobulked yarn of claim 1 in which said first yarn is at least 95 percent by weight of the cobulked yarn.

3. The cobulked yarn of claim 2 in which the filaments of said second yarn are 6 to 13 percent longer than the filaments of said first yarn.

4. The cobulked yarn of claim 1 in which said first yarn is a non-conductive yarn, said second yarn is a conductive yarn, and the cobulked yarn is antistatic.

5. The cobulked yarn of claim 4 in which the non-conductive yarn is nylon and is at least 50 percent by weight of the cobulked yarn.

6. The cobulked yarn of claim 5 in which the filaments of the conductive yarn are 6 to 13 percent longer than the filaments of the non-conductive yarn.

7. The cobulked yarn of claim 6 in which the non-conductive yarn is at least 95 percent by weight of the cobulked yarn.

8. Method of producing a cobulked continuous filament yarn containing filaments of a first continuous filament yarn and filaments of a second continuous filament yarn in which the filaments of said second yarn are frequently located near the surface of said cobulked yarn which comprises 1. feeding said first yarn at a controlled rate of speed,
2. wrapping said first yarn at least four times around a pair of rolls driven at a rate at least twice the feed rate, thereby drawing said first yarn,
3. feeding to the pair of rolls, at a tension of less than 0.6 gram per denier, said second yarn having a lower shrinkage potential in a hot gas bulking jet than the drawn, first yarn,
4. wrapping said second yarn at least four times around the pair of rolls,
5. bringing said first and second yarns together on the rolls thereby forming a combined yarn,
6. forwarding the combined yarn in a high velocity stream of hot turbulent fluid in a confined space to randomly crimp and entangle the filaments thereby forming a cobulked yarn in which the filaments of said second yarn are 4 to 20% longer than the filaments of said first yarn,
7. removing the cobulked yarn from the stream of hot fluid, and
8. allowing the cobulked yarn to cool at low tension while the filaments are in a crimped condition.

9. The method of claim 8 in which said second yarn is nylon.

10. The method of claim 9 in which said second yarn is separated from said first yarn at least during the first one-half wrap around the pair of rolls.

11. The method of claim 10 in which the filaments of said second yarn in the resulting cobulked yarn are 6 to 13 percent longer than the filaments of said first yarn.

12. The method of claim 11 in which said first yarn is at least 95 percent by weight of the cobulked yarn.

13. The method of claim 12 in which said second yarn is fed to the pair of rolls at a tension which causes less than 5 percent elongation.

14. The method of claim 9 in which the first yarn is non-conductive, the second yarn is conductive, and the resulting cobulked yarn is antistatic.

15. The method of claim 14 in which the conductive yarn is separated from the non-conductive yarn at least during the first one-half wrap around the pair of rolls.

16. The method of claim 15 in which the non-conductive yarn is nylon and is at least 50 percent by weight of the cobulked yarn.

17. The method of claim 16 in which the filaments of the conductive yarn in the resulting cobulked yarn are 6 to 13 percent longer than the filaments of the non-conductive yarn.

18. The method of claim 17 in which the non-conductive yarn is at least 95 percent by weight of the cobulked yarn.

19. The method of claim 18 in which the conductive yarn is fed to the pair of rolls at a tension which causes less than 5 percent elongation.

* * * * *